US011417939B2

(12) United States Patent
Akens et al.

(10) Patent No.: US 11,417,939 B2
(45) Date of Patent: Aug. 16, 2022

(54) ANTENNA FOR A PORTABLE COMMUNICATION DEVICE

(71) Applicant: MOTOROLA SOLUTIONS, INC., Chicago, IL (US)

(72) Inventors: Jody H Akens, Weston, FL (US); Maryam Eneim, Boca Raton, FL (US); Dennis A Byk, Ft. Lauderdale, FL (US); Sean Regan, Boca Raton, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 41 days.

(21) Appl. No.: 17/115,220

(22) Filed: Dec. 8, 2020

(65) Prior Publication Data

US 2022/0181763 A1 Jun. 9, 2022

(51) Int. Cl.

| | |
|---|---|
| ***H01Q 1/00*** | (2006.01) |
| ***H01Q 1/08*** | (2006.01) |
| ***H01Q 1/24*** | (2006.01) |
| ***H01Q 1/18*** | (2006.01) |

(52) U.S. Cl.

CPC ..... *H01Q 1/002* (2013.01); *H01Q 1/085* (2013.01); *H01Q 1/243* (2013.01); *H01Q 1/18* (2013.01)

(58) Field of Classification Search

CPC ..... H01Q 1/002; H01Q 1/085; H01Q 1/1242; H01Q 1/125; H01Q 1/242; H01Q 1/243; H01Q 1/244; H01Q 1/273; H01Q 1/36; H01Q 1/362; H01Q 1/52; H01Q 3/24; H01Q 7/00; H01Q 7/02; H01Q 7/08; H01Q 5/307; H01Q 5/335; H01Q 5/357; H01Q 5/40; H01Q 5/50; H01Q 11/08; H01Q 11/083; H01Q 21/28; H01Q 21/30

See application file for complete search history.

(56) References Cited

U.S. PATENT DOCUMENTS

| | | | | |
|---|---|---|---|---|
| 8,884,838 | B2 | 11/2014 | Contreras et al. | |
| 9,124,676 | B2 | 9/2015 | Allore et al. | |
| 9,343,800 | B2 | 5/2016 | Tran et al. | |
| 9,666,938 | B2 | 5/2017 | Oon et al. | |
| 10,135,139 | B2 * | 11/2018 | Contreras | H01Q 1/244 |
| 2020/0116870 | A1 * | 4/2020 | Yost | G01S 19/36 |

FOREIGN PATENT DOCUMENTS

| | | | |
|---|---|---|---|
| KR | 200397908 | Y1 * | 10/2005 |
| KR | 101298945 | B1 * | 8/2013 |

* cited by examiner

*Primary Examiner* — Dameon E Levi
*Assistant Examiner* — Leah Rosenberg
(74) *Attorney, Agent, or Firm* — Barbara R. Doutre

(57) ABSTRACT

An antenna for a portable communication device is provided. The antenna comprises an antenna body having an upper section and a lower section with a connection point therebetween. The connection point being configured to: couple the upper and lower sections during normal antenna operation; decouple the upper and lower sections in response to an impact event; and recouple the upper and lower sections after the impact event.

19 Claims, 5 Drawing Sheets

ANTENNA FOR A PORTABLE COMMUNICATION DEVICE

FIELD OF THE INVENTION

The present invention relates generally to antennas and more particularly to an antenna for a portable communication device.

BACKGROUND

Many portable communication devices, such as public safety two-way radios, utilize external antennas to meet desired power and frequency range requirements. The length of certain antennas, such as those used in land mobile radio (LMR) applications are very long making it difficult to prevent such antennas from being damaged during a drop event. For example, a UHF antenna for a portable LMR radio may have a length ranging from 14-20 cm and a VHF antenna may have a length ranging from 18-22 cm. New operational requirements and standards are evolving, particularly in the area of fire rescue, which seek out improved performance during a drop event—basically challenging designers to provide antennas that will operate even if broken upon impact.

Accordingly, there is a need for an improved antenna for a portable communication device.

BRIEF DESCRIPTION OF THE FIGURES

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
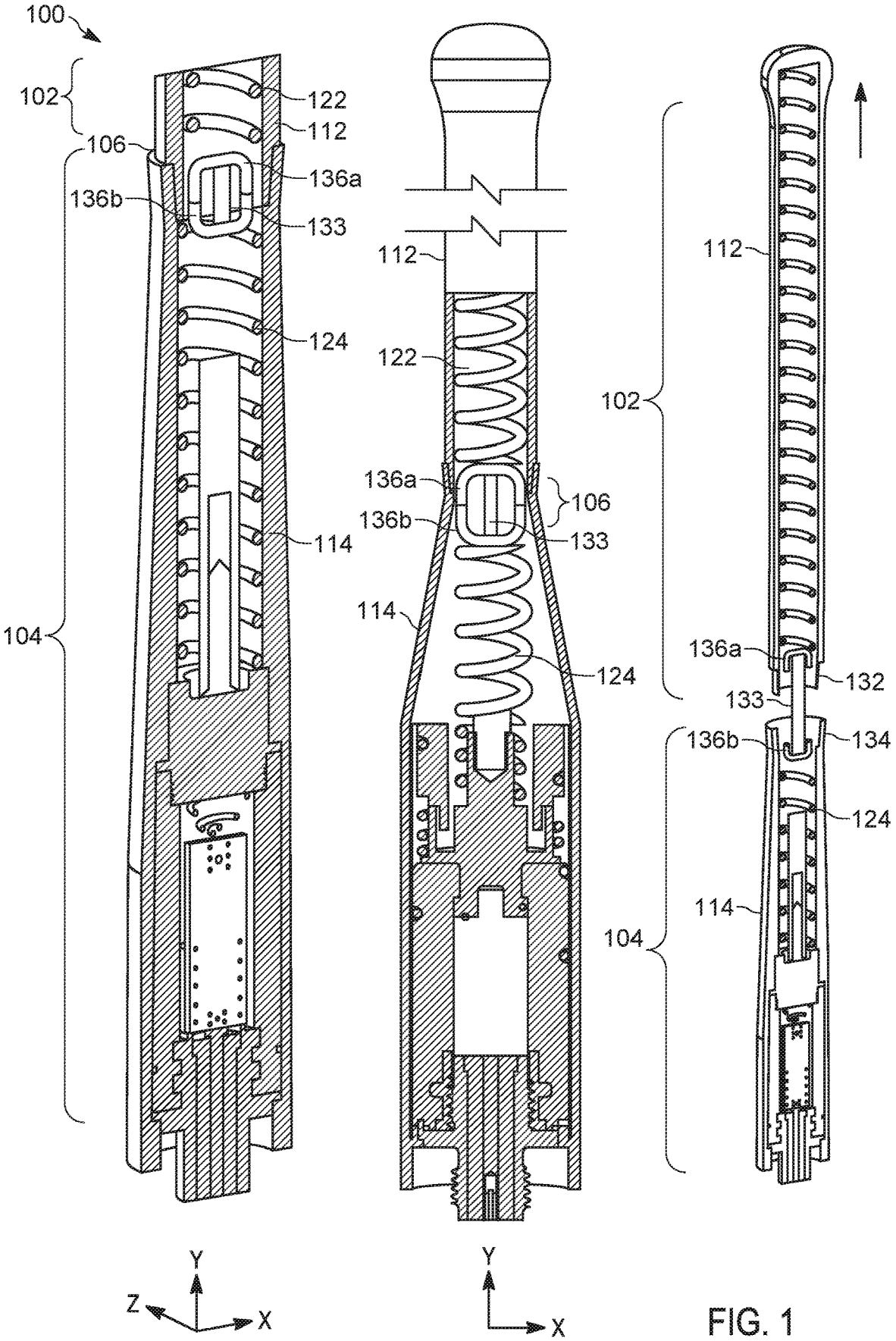
FIG. 1 is an antenna formed in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in an improved antenna for a portable communication device Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Briefly, there is provided herein, an antenna for a portable communication device, the antenna comprising: an antenna body having an upper section and a lower section with a connection point therebetween, the connection point being configured to: couple the upper and lower sections during normal antenna operation; decouple the upper and lower sections in response to an impact event; and recouple the upper and lower sections after the impact event. In some embodiments, the connection point comprises first and second magnetic elements and a non-metallic elastomeric tether between the first and second antenna sections. In other embodiments, the connection point comprises an extension spring coupling the upper and lower antenna sections. In other embodiments, the upper antenna section, the connection point and the lower antenna section are formed as one single coil, and the single coil is extendable and retractable in response to an impact event FIG. 1 is an antenna 100 for a portable communication device, the antenna being formed in accordance with some embodiments. Coupled and separated, partial cutaway views are shown. The antenna 100 comprises an antenna body having an upper section 102 and a lower section 104 with a connection point 106 therebetween. In accordance with the embodiments, the connection point 106 is configured to: couple the upper and lower sections 102, 104 during normal antenna operation; decouple the upper and lower sections in response to an impact event; and recouple the upper and lower sections after the impact event.

In accordance with some embodiments, the upper section 102 of the antenna 100 comprises an upper sheath portion 112, and the lower section 104 of the antenna comprises a lower sheath portion 114, the upper and lower sheath portions being configured to separate in response to an impact event. The upper and lower sheath portions 112, 114 respectively comprise an upper coil 122 and a lower coil 124 which are retained by a pair of magnets 136*a*, 136*b*.

The upper sheath portion 112 may be partially nested within the lower sheath portion 114. The upper sheath portion 112 and lower sheath portion 114 are separate piece parts coupled via an interference fit between an inner cup 132 on upper sheath portion 112 and an outer cup 134 of the lower sheath portion 114. For example, the outside diameter of the inner cup 132 may fit with a corresponding surface of an inner diameter of the outer cup 134. In accordance with the embodiment shown in FIG. 1, the connection point 106 comprises the pair of magnets 136*a*, 136*b* magnetically coupled between the upper section 102 and the lower section 104. The pair of magnets 136*a*, 136*b* is tethered via a tether 133, preferably a non-metallic elastomeric tether. The magnetic force of the magnets 136*a*, 136*b* also retain the upper sheath portion 112 in a tightly coupled and aligned configuration with the lower sheath portion 114 as part of the nesting configuration.

In response to an impact event that may temporarily separate the upper sheath portion 112 having upper magnet 136*a* from the lower sheath portion 114 having lower magnet 136*b*, the elastomeric pull of the tether 133 and magnetic pull of the magnets 136*a*, 136*b*, pull the upper section 102 of antenna 100 back to the lower section 104 thereby recoupling the upper and lower coils 122, 124.

Hence, the connection point 106 of FIG. 1 can be said to comprise first and second magnetic elements 136*a*, 136*b* and non-metallic elastomeric tether 133 between the first and second magnetic elements, the magnetic elements and tether being arranged to: remain connected during normal operation; temporarily separate in response to the impact event; and automatically reconnect via the magnets in response to the elastomeric tether pulling the first and second sections back.

For the embodiment of FIG. 1, the upper coil 122 of the upper section 102 preferably comprises a fixed length upper coil 122, and the lower coil 124 of the lower section 104 preferably comprises a fixed length lower coil 124 which are retained by the pair of magnets 136*a*, 136*b*. For example, the upper and lower fixed length coils 122, 124 may have electrical contact interfaces that are held in contact via the magnetic force of the magnets 136*a*, 136*b*. The pull force of the magnetic elements 136*a*, 136*b* is sufficient for re-alignment but sufficiently weak so as not to impact RF performance of the antenna 100. In accordance with the embodiments, upper section 102 bends and separates in response to a predetermined load applied to the antenna, such as would be incurred during a drop impact event of a portable communication device, the impact event being sufficient to separate the magnets 136*a*, 136*b*. In accordance with the embodiments, the magnetic force of the magnets 136*a*, 136*b* and elastic load of the tether 133 enable the upper section 102 to be reassembled with the lower section 104. The first and second magnets 136*a*, 136*b* provide alignment and connectivity to recouple the upper antenna section 102 to the lower antenna section 104. The alignment may be adjusted by a user where again the magnets 136*a*, 136*b* and tether 133 provide for the self-reassembly.

Figure 2:
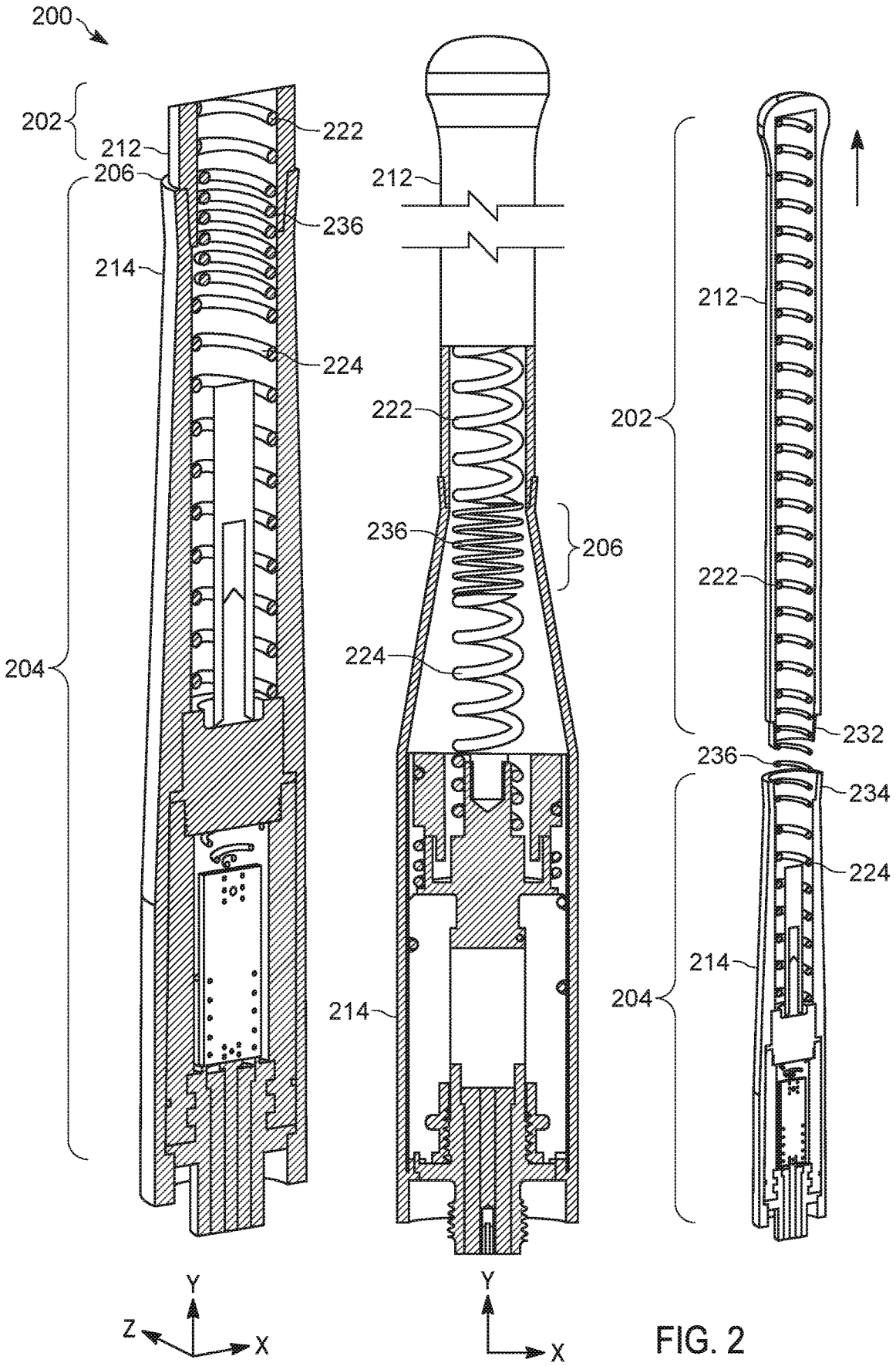
FIG. 2 is another antenna formed in accordance with some embodiments.

FIG. 2 is another antenna 200 for a portable communication device formed in accordance with some embodiments. Coupled and separated, partial cutaway views are shown. The antenna 200 comprises an antenna body having an upper section 202 and a lower section 204 with a connection point 206 therebetween. In accordance with the embodiments, the connection point is configured to: couple the upper and lower sections 202, 204 during normal antenna operation; decouple the upper and lower sections in response to an impact event; and recouple the upper and lower sections after the impact event.

In accordance with some embodiments, the upper section 202 of the antenna 200 comprises an upper sheath portion 212, and the lower section 204 of the antenna comprises a lower sheath portion 214, the upper and lower sheath portions being configured to separate in response to an impact event. The upper sheath portion 212 may be partially nested within the lower sheath portion 214. The upper sheath portion 212 and lower sheath portion 214 are separate piece parts coupled via an interference fit between an inner cup 232 on upper sheath portion 212 and an outer cup of the lower sheath portion 214. For example, the outside diameter of the inner cup 232 may fit with a corresponding surface of an inner diameter of the outer cup 234. The upper sheath portion 212 realigns with the lower sheath portion 214 after the impact event.

In accordance with the embodiment of FIG. 2, the top antenna section 202 comprises an upper fixed length coil 222, and the lower antenna section 204 comprises a lower fixed length coil 224 and the upper fixed length coil and lower fixed length coil are connected via a connection point 206 comprising an extension metal spring 236, the extension metal spring being extendable and retractable in response the impact event to the antenna. The extension metal spring 236 provides a mid-coil section that expands and contracts in response to an impact event, while the fixed upper fixed length coil 222 and lower fixed length coil 224 remain fixed. The spring force of the metal spring 236 also retains the upper sheath portion 212 in tightly coupled condition with the lower sheath portion 214 as part of the nesting configuration.

In accordance with the embodiment of FIG. 2, the extension metal spring 236 provides a mid-coil that is rigidly attached to the upper fixed length coil 222 and the lower fixed length coil 224. The metal spring 236 is expandable and retractable. In accordance with the embodiments, upper section 202 bends and separates from lower section 204 in response to a predetermined load applied to the antenna 200, such as would be incurred during a drop impact event of a portable communication device. In accordance with the embodiments, the extension metal spring 236 enables the upper section 202 to be reassembled with the lower section 204. The extension metal spring 236 is formed of sufficient tensile and compressive strengths so as to stretch upon impact and then retract back into alignment thereby self-aligning the upper antenna section 202 to the lower antenna section 204. The alignment can be further adjusted by a user if needed.

Upon impact, the upper section 202 bends and separates (but does not detach) from lower section 204, by expanding the tightly wound mid-coil section provided by the extension metal spring 236. Upon separation, the mid-coil extends, but does not permanently deform in a vertical, y-direction (of the x-y-z axis shown in the figures). The spring load of the extension metal spring 236 is sufficient to enable to upper section 202 to be reassembled by the spring load of the mid-coil. A user can also further move and adjust the upper section 202 to improve alignment with the lower section 204, if needed. Hence, antenna 200 is able to advantageously self-reassemble.

Embodiments provided and described in conjunction with FIGS. 1 and 2 provide the advantageous ability to use fixed length helical coil radiator elements in the upper and lower sections of the antenna (without the use of any radiator flex element). Such coils are far more cost effective and improve ease of manufacturability than flex (ribbon style) approaches which require wrapping, controlled spacing and overlapping.

Figure 3:
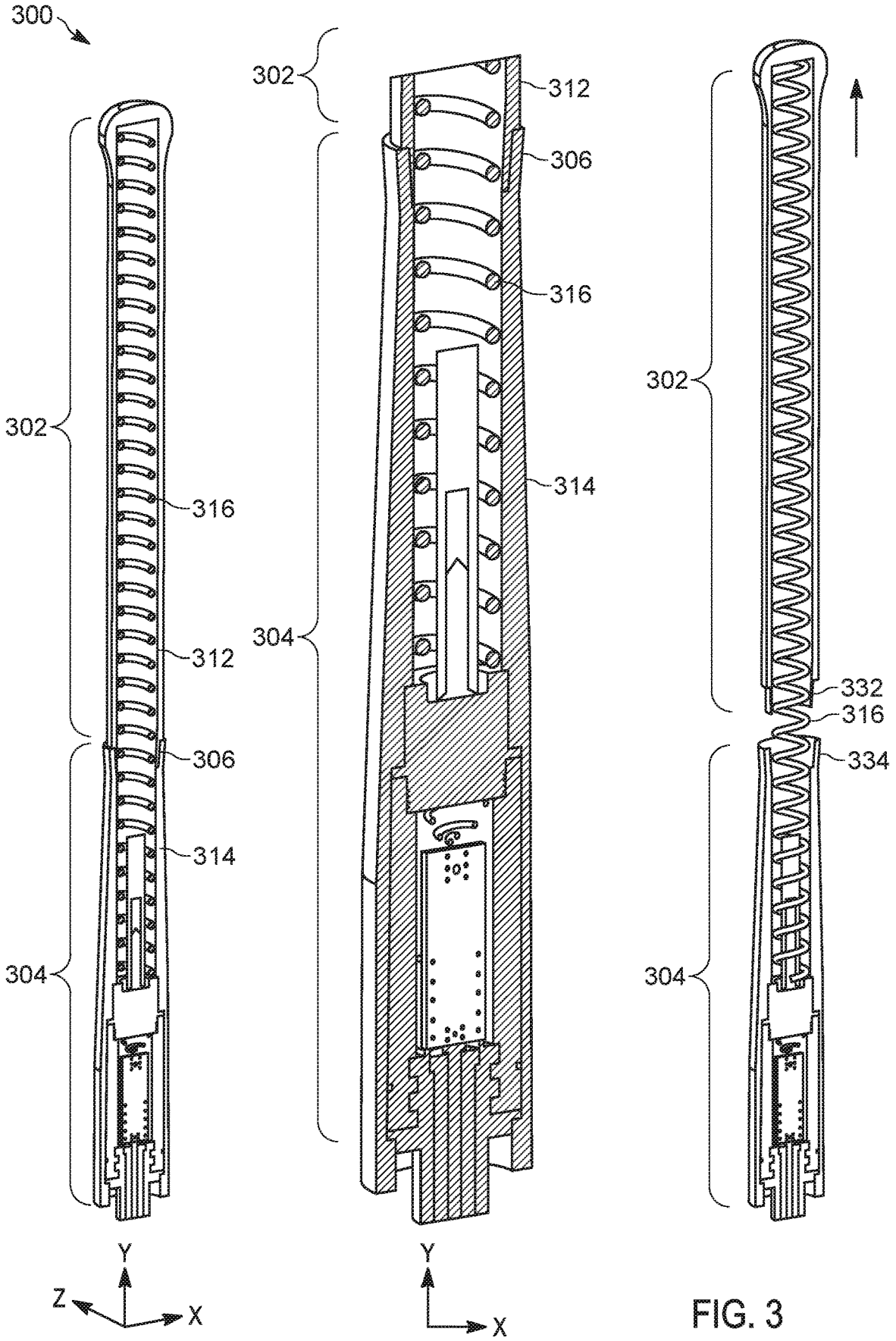
FIG. 3 is another antenna formed in accordance with some embodiments.

FIG. 3 is another antenna 300 for a portable communication device, the antenna being formed in accordance with some embodiments. Coupled and separated, partial cutaway views are shown. The antenna 300 comprises an antenna body having an upper section 302 and a lower section 304 with a connection point 306 therebetween. In accordance with the embodiments, the connection point is configured to: couple the upper and lower sections 302, 304 during normal antenna operation; decouple the upper and lower sections in response to an impact event; and recouple the upper and lower sections after the impact event.

In accordance with some embodiments, the upper section 302 of the antenna 300 comprises an upper sheath portion 312, and the lower section 304 of the antenna comprises a lower sheath portion 314, the upper and lower sheath portions being configured to separate in response to an impact event. The upper sheath portion 312 may be partially nested within the lower sheath portion 314. The upper sheath portion 312 and lower sheath portion 314 are separate piece parts coupled via a slight interference fit between an inner cup 31 of upper sheath portion 314 and an outer cup of upper sheath portion 312. For example, the outside diameter of the inner cup 332 may fit with a corresponding surface of an inner diameter of the outer cup 334. The upper sheath portion 312 realigns with the lower sheath portion 314 after the impact event. In accordance with the embodiment shown in FIG. 3, the upper antenna section 302, the connection point 306 and the lower antenna section 304 are formed as one single coil 316, and the single coil is extendable and retractable in response to an impact event. The upper and lower sheath portions 312, 314 are held in a tightly coupled condition via the interference fit of the sheaths and spring tension of the single coil 316. For example, the upper sheath portion 312 can be pulled straight up allowing the entire coil 316 to expand, and the upper sheath portion can be released allowing the coil to retract pulling with it the upper sheath for re-nesting into the connection point 306.

In accordance with the embodiments, the entire single coil 316 can bend (but only the upper sheath portion 312 will detach from the lower sheath portion 314) in response to a predetermined load applied to the antenna, such as would be incurred during a drop impact event of a portable communication device, the impact event being sufficient to separate the sheaths. In accordance with the embodiments, the retraction of the single coil 316 provides re-alignment of the upper sheath portion 312 within the nesting provided by the lower sheath portion 314, thus providing for self-reassembly. A user can adjust the alignment if needed.

Figure 4:
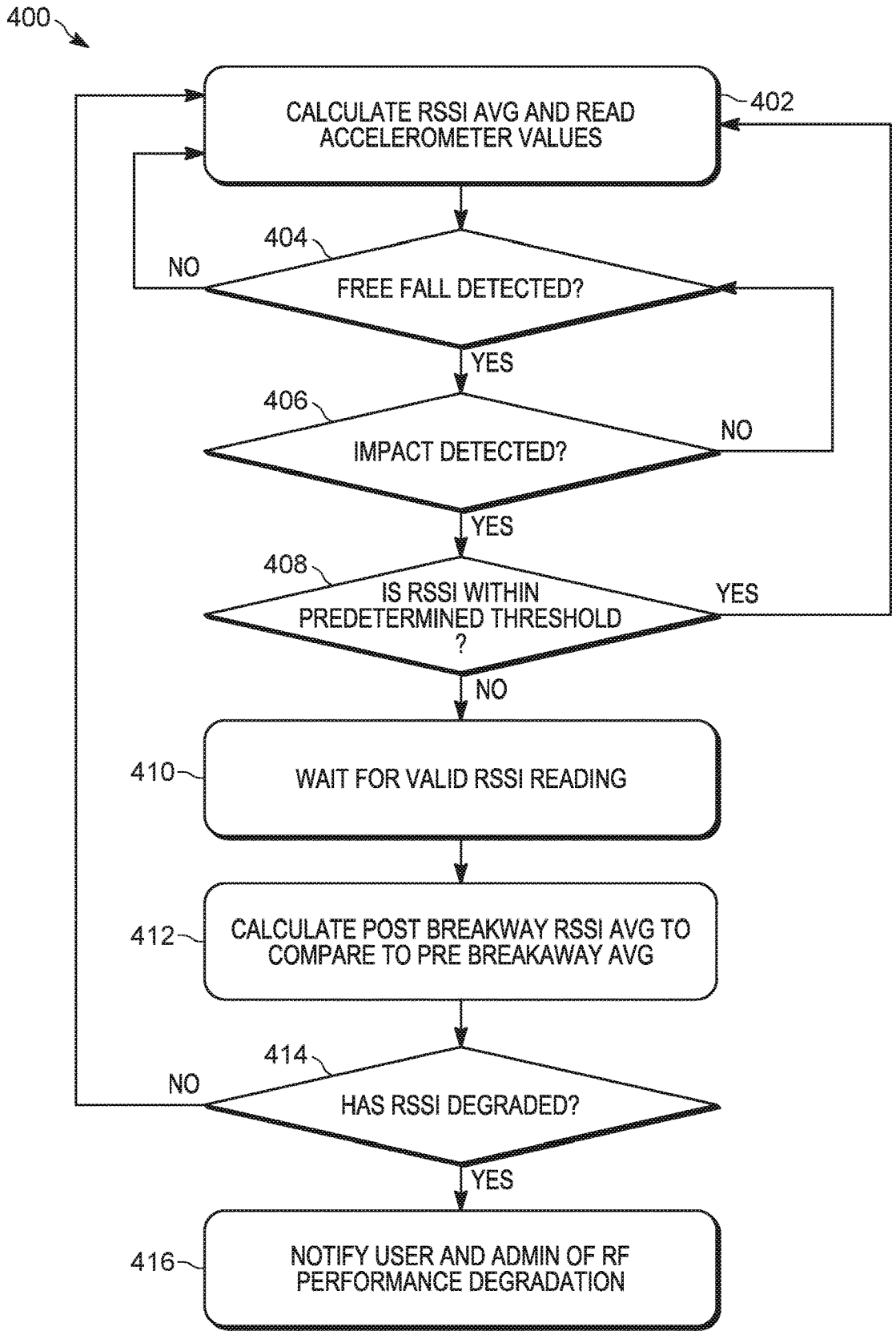
FIG. 4 is a method of tracking antenna analytics in accordance with some embodiments.
Figure 5:
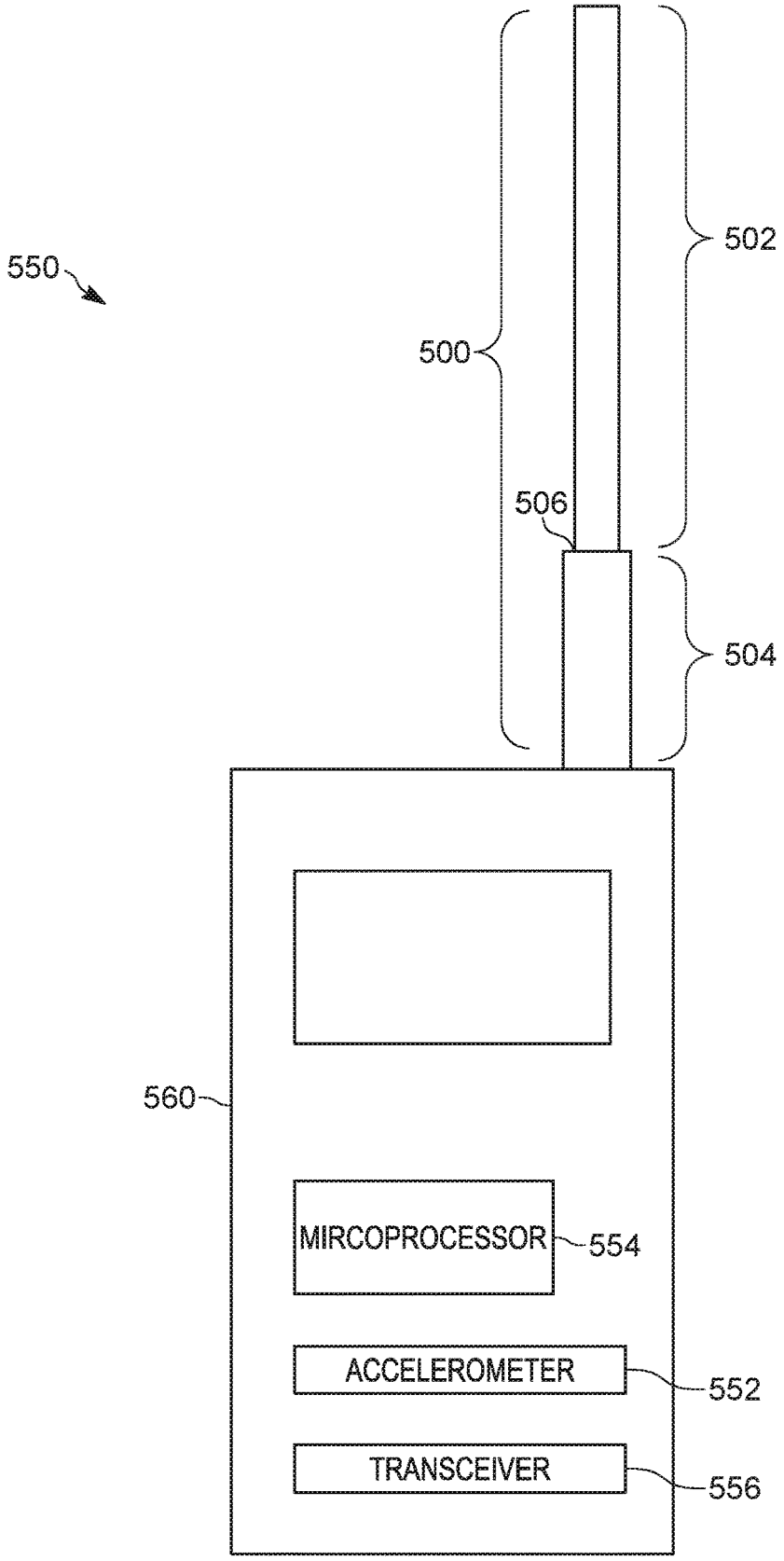
FIG. 5 is a portable communication device with an external antenna formed in accordance with some embodiments.

The various antenna embodiments are well suited to external antenna applications for a portable communication device, such as a two-way radio (shown and described in conjunction with FIG. 5). FIG. 4 is a method 400 of tracking antenna analytics in accordance with some embodiments. Method 400 is performed by a portable radio having a transceiver, microprocessor and sensor, such as an accelerometer, operating therein and operatively coupled to the external antenna. A sensor such as an accelerometer can detect and measure free fall and impact events. Beginning at 402, received signal strength indicator (RSSI) values and accelerometer values are read and an average reference RSSI value is calculated during normal radio usage. These averages are considered pre-breakaway averages taken during normal portable radio operation, where the RSSI will vary based on the distance from the signal transmitter (base station, repeater, to name a few) as well as by how the radio is positioned (for example, on a table, in hand, on hip, to name a few). The reference RSSI may be referred as a moving RSSI since it ties back to the portability aspect of the radio. For the purposes of this application the average reference RSSI value can also be said to fall within an acceptable average RSSI range of values. Upon detection of freefall event 404, followed by an impact event 406, the RSSI is checked at 408 and compared to a predetermined threshold, the predetermined threshold being set by the n acceptable average RSSI range of values. If the RSSI falls within the predetermined threshold, at 408 then the method returns back to 402 (no damage detected) after a predetermined time over which additional readings can be made. If the RSSI is not within the predetermined threshold at 408, then the method waits for a valid RSSI reading at 410. A valid RSSI reading is a stable reading taken post-impact (as opposed to those readings that may have been taken during the free fall prior to impact). Once a valid RSSI reading is obtained at 410, a post breakaway RSSI average is taken and compared, at 412, to the pre breakaway RSSI reference average (i.e. the average RSSI range of values obtained at step 402). If the post breakaway RSSI average is determined to be degraded at 414, then a notification is generated at 416. Such notifications can be sent to a user of the radio or a system administrator, via a display message, audible message, LED, or other notification means. If the post breakaway RSSI average has not degraded then the method returns back to 402.

Method 400 can be summarized as calculating averages of received signal strength indicator (RSSI) values prior to free fall detection and after impact detection, comparing the average RSSI value after impact detection to the average RSSI value prior to free fall detection; determining when the comparison exceeds a predetermined RSSI degradation threshold; and generating a notification of degraded performance when the comparison exceeds the predetermined RSSI impact degradation threshold.

FIG. 5 is a portable communication device 550 with an external antenna 500 formed in accordance with some embodiments. The external antenna 500 may comprise any of the previously described antennas or variations thereof. The portable communication device 550 may be a radio, such as for example a battery powered two-way radio having push-to-talk (PTT) capability operating within a land mobile radio (LMR) network. The portable radio may operate, for example, using VHF (136-174 MHz), or UHF (380-527 MHz) frequency bands. The portable radio 550 comprises a radio housing 560 having the external antenna 500 coupled thereto, such as for LMR operation. As provided by the various embodiments, the external antenna 500 comprises an antenna body having an upper section 502 and a lower section 504 with a connection point 506 therebetween, the connection point being configured to: couple the upper and lower sections during normal antenna operation; decouple the upper and lower sections in response to an impact event; and recouple the upper and lower sections after the impact event. For example, the connection point 506 may comprise one of the previously described: pair of magnets coupled between the upper section 502 and the lower section 504; a metal spring coupled between the upper section and the lower section; or a single coil formed as part of the upper section and the lower section.

In accordance with some embodiment, the portable radio 550 further comprises an accelerometer 552, or other free fall detection device, for detecting free fall and impact of the portable radio, along with a microprocessor 554 and transceiver 556 operatively coupled to the accelerometer and to the antenna 500. In accordance with some embodiments, the microprocessor 554 is configured to: calculate an average of received signal strength indicator (RSSI) values prior to free fall detection and after impact detection; compare the average RSSI value after impact detection to the average of RSSI values prior to free fall detection; determine when the comparison exceeds a predetermined RSSI degradation threshold; and generate a notification of degraded performance when the comparison exceeds the predetermined impact degradation threshold.

Accordingly there has been provided an improved antenna for a portable communication device. The embodiments have provided for an antenna that can be realigned and snapped back into place after an impact event. The connection point provided between the upper and lower section of the antenna advantageously enables a temporary separation or stretch in response to an impact event, thereby allowing the antenna to snap back to its original configuration after the impact event. The connection point has been described but is not intended to be limited to: a pair of magnets coupled between the upper section and the lower section; a metal spring coupled between the upper section and the lower section; a single coil formed as part of the upper section and the lower section. The embodiments are particularly well suited to antenna designs that do not use a flex (i.e. ribbon flex). A portable radio having an antenna provided by the embodiments can beneficially maintain operation even after a drop impact event and provide analytics as to antenna performance prior to, during, and after a drop impact event.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An antenna for a portable communication device, the antenna comprising:

an antenna body having an upper section and a lower section with a connection point therebetween, the connection point being configured to:

couple the upper and lower sections during normal antenna operation;

decouple the upper and lower sections in response to an impact event; and recouple the upper and lower sections after the impact event; and wherein the upper and lower sections comprise helical coil radiator elements formed without a flex.

2. The antenna of claim 1, wherein the upper section comprises an upper sheath portion, and the lower section comprises a lower sheath portion, the upper and lower sheath portions being configured to separate in response to the impact event.

3. The antenna of claim 2, wherein the upper sheath portion is partially nested within the lower sheath portion.

4. The antenna of claim 2, wherein the upper sheath portion realigns with the lower sheath portion after the impact event.

5. The antenna of claim 4, wherein the upper sheath portion realigns with the lower sheath portion after the impact event via the connection point.

6. The antenna of claim 1, wherein the connection point comprises one of:

a pair of magnets coupled between the upper section and the lower section;

a metal spring coupled between the upper section and the lower section; and a single coil formed as part of the upper section and the lower section.

7. An antenna for a portable communication device, the antenna comprising:

an antenna body having an upper section and a lower section with a connection point therebetween, the connection point being configured to:

couple the upper and lower sections during normal antenna operation;

decouple the upper and lower sections in response to an impact event; and recouple the upper and lower sections after the impact event; and wherein the connection point comprises first and second magnetic elements and a non-metallic elastomeric tether between the first and second magnetic elements, the first and second magnetic elements and tether arranged to:

remain connected during normal operation;

temporarily separate in response to the impact event; and automatically reconnect via the first and second magnetic elements in response to the elastomeric tether pulling the upper section back to the lower section.

8. The antenna of claim 7, wherein the first and second magnetic elements provide alignment and connectivity to recouple the upper section to the lower section.

9. An antenna for a portable communication device, the antenna comprising: an antenna body having an upper section and a lower section with a connection point therebetween, the connection point being configured to: couple the upper and lower sections during normal antenna operation; decouple the upper and lower sections in response to an impact event; and recouple the upper and lower sections after the impact event;

and wherein the connection point has a magnetic pull that provides re-alignment and connectivity without impact to RF performance of the antenna.

10. An antenna for a portable communication device, the antenna comprising:

an antenna body having an upper section and a lower section with a connection point therebetween, the connection point being configured to:

couple the upper and lower sections during normal antenna operation;

decouple the upper and lower sections in response to an impact event; and recouple the upper and lower sections after the impact event and wherein the upper section comprises an upper fixed length coil and the lower section comprises a lower fixed length coil, and the upper fixed length coil and lower fixed length coil are connected via a connection point comprising an extension metal spring, the extension metal spring being extendable and retractable in response the impact event.

11. The antenna of claim 10, wherein only the extension metal spring expands and contracts in response to an impact event, while the upper fixed length coil and the lower fixed length coil remain fixed.

12. An antenna for a portable communication device, the antenna comprising:

an antenna body having an upper section and a lower section with a connection point therebetween, the connection point being configured to:

couple the upper and lower sections during normal antenna operation;

decouple the upper and lower sections in response to an impact event; and recouple the upper and lower sections after the impact event; and wherein the upper section, the connection point and the lower section are formed as one single coil, and the single coil is extendable and retractable in response to the impact event.

13. The antenna of claim 12, wherein the upper section comprises an upper sheath portion and the lower section comprises a lower sheath portion, and the upper sheath portion realigns with the lower sheath portion after the impact event.

14. The antenna of claim 1, wherein the antenna is a land mobile radio (LMR) antenna.

15. A portable radio, comprising:

a radio housing; and an external antenna coupled to the radio housing, the external antenna comprising:

an antenna body having an upper section and a lower section with a connection point therebetween, the connection point being configured to:

couple the upper and lower sections during normal antenna operation;

decouple the upper and lower sections in response to an impact event; and recouple the upper and lower sections after the impact event; and wherein the upper and lower sections comprise helical coil radiator elements formed without a flex.

16. The portable radio of claim 15, wherein the connection point comprises one of:

a pair of magnets coupled between the upper section and the lower section;

a metal spring coupled between the upper section and the lower section; and a single coil formed as part of the upper section and the lower section.

17. The portable radio of claim 15, wherein the upper section comprises an upper sheath portion, and the lower section comprises a lower sheath portion, the upper sheath portion being partially nested within the lower sheath portion, the upper and lower sheath portions being configured to separate in response to the impact event and recouple via the connection point after the impact event.

18. The portable radio of claim 15, wherein the external antenna is a land mobile radio (LMR) antenna.

19. A portable radio, comprising:

a radio housing; and an external antenna coupled to the radio housing, the external antenna comprising:

an antenna body having an upper section and a lower section with a connection point therebetween, the connection point being configured to:

couple the upper and lower sections during normal antenna operation;

decouple the upper and lower sections in response to an impact event; and recouple the upper and lower sections after the impact event; and wherein the portable radio further comprises:

an accelerometer for detecting free fall and impact of the portable radio; and a microprocessor operatively coupled to the accelerometer and to the external antenna, the microprocessor being configured to:

calculate an average of received signal strength indicator (RSSI) values prior to free fall detection and after impact detection;

compare the average RSSI value after impact detection to the average RSSI value prior to free fall detection;

determine when the comparison exceeds a predetermined impact degradation threshold; and generate a notification of performance when the comparison exceeds the predetermined impact degradation threshold.

* * * * *